US008876270B2

(12) United States Patent
Munakata

(10) Patent No.: US 8,876,270 B2
(45) Date of Patent: Nov. 4, 2014

(54) LIQUID EJECTION APPARATUS

(71) Applicant: Seiko Epson Corporation, Tokyo (JP)

(72) Inventor: Manabu Munakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 13/745,119

(22) Filed: Jan. 18, 2013

(65) Prior Publication Data

US 2013/0187978 A1 Jul. 25, 2013

(30) Foreign Application Priority Data

Jan. 20, 2012 (JP) ..... 2012-010508

(51) Int. Cl.
*B41J 2/175* (2006.01)
*B41J 2/19* (2006.01)
*B41J 2/165* (2006.01)

(52) U.S. Cl.
CPC .. *B41J 2/19* (2013.01); *B41J 2/175* (2013.01); *B41J 2/175133* (2013.01); *B41J 2/16532* (2013.01); *B41J 2/17563* (2013.01)
USPC ..... 347/93; 347/92; 347/84; 347/85

(58) Field of Classification Search
USPC ..... 347/93, 92, 84, 85, 86
See application file for complete search history.

(56) References Cited

U.S. PATENT DOCUMENTS

2010/0225718 A1* 9/2010 Uezawa ..... 347/93

FOREIGN PATENT DOCUMENTS

JP 2000-296622 10/2000
JP 2010-201829 9/2010

* cited by examiner

*Primary Examiner* — Henok Legesse
(74) *Attorney, Agent, or Firm* — Workman Nydegger

(57) ABSTRACT

A liquid ejection apparatus includes a liquid ejecting head having a head body that ejects liquid from nozzle openings and a flow path member that includes a liquid flow path through which the liquid is supplied to the head body, the liquid flow path being provided with a filter chamber disposed at a position in the liquid flow path with a filter disposed inside the filter chamber, and a portion of the filter chamber which opposes the filter being made of an elastic member; a pressing unit that presses the elastic member toward the filter; and a suction unit that suctions the liquid in the liquid flow path from the nozzle openings.

6 Claims, 14 Drawing Sheets

LIQUID EJECTION APPARATUS

BACKGROUND

1. Technical Field

The present invention relates to liquid ejection apparatuses including a liquid ejecting head that ejects liquid, and more specifically to ink jet recording apparatuses including an ink jet recording head that ejects ink as an example of liquid.

2. Related Art

In an ink jet recording head which is a typical example of liquid ejecting head, ink is generally supplied from a liquid storing unit such as an ink cartridge that stores ink to a head body. Then, ink is ejected from nozzle openings as ink droplets by driving pressure generating units such as piezoelectric elements and heat generating elements.

Such an ink jet recording head has a problem that air bubbles contained in ink or air bubbles entrained in ink during attachment or removal of the liquid storing unit may enter the ink jet recording head, leading to an ejection failure such as missing dots. In order to solve such a problem, ink jet recording head may have a filter disposed at a position in a liquid flow path between an ink supply needle inserted into the ink cartridge and the ink jet recording head so as to remove the air bubbles and foreign matters in ink.

Such a filter disposed in the liquid flow path can prevent the air bubbles from entering the head body, however has a problem the air bubbles trapped in a filter chamber which is a space upstream of the filter are not easily discharged.

JP-A-2000-296622 and JP-A-2010-201829 propose to provide a wall made of an elastic member in a filter chamber at a position opposite a filter so as to deform toward and away from the filter.

However, in this configuration, there is a problem in that a large expensive suction unit having a high suction force is necessary to discharge the air bubbles trapped on the filter by suctioning ink from nozzle openings.

Such a problem exists not only in ink jet recording apparatuses but only in liquid ejection apparatuses ejecting a liquid other than ink.

SUMMARY

An advantage of some aspects of the invention is that a liquid ejection apparatus capable of performing a reliable cleaning operation by using a suction unit with a low suction force thereby reducing a cost and a size is provided.

According to an aspect of the invention, a liquid ejection apparatus includes a liquid ejecting head having a head body that ejects liquid from nozzle openings and a flow path member that includes a liquid flow path through which the liquid is supplied to the head body, the liquid flow path being provided with a filter chamber disposed at a position in the liquid flow path with a filter disposed inside the filter chamber, and a portion of the filter chamber which opposes the filter being made of an elastic member; a pressing unit that presses the elastic member toward the filter; and a suction unit that suctions the liquid in the liquid flow path from the nozzle openings. With this configuration, since the air bubbles trapped on the filter can be moved downstream of the liquid flow path by pressing the elastic member toward the filter by using the pressing unit, the suction unit does not need to have a high suction force for suctioning the air bubbles across the filter. Accordingly, it is possible to use a small inexpensive suction unit having a low suction force.

In the above aspect of the invention, it is desirable that the filter chamber is formed in a dome shape that protrudes in a direction opposite to the filter. With this configuration, it is possible to elastically deform the wall which forms the filter chamber toward the filter in an efficient manner and to allow the wall to easily return in a direction away from the filter.

In the above aspect of the invention, it is desirable that a wall made of the elastic member that forms the filter chamber has a peripheral area that is inclined in a direction away from the filter and a center area that is formed to protrude toward the filter. With this configuration, it is possible to elastically deform the wall which forms the filter chamber toward the filter in an efficient manner and to allow the wall to easily return in a direction away from the filter.

In the above aspect of the invention, it is desirable that a the liquid ejecting head is movable in a main scan direction and a plurality of filter chambers are positioned side by side in a direction perpendicular to the main scan direction. With this configuration, it is possible to selectively press the elastic member that corresponds to the filter of the liquid flow paths by using the pressing pins fixed to the apparatus body. In addition to that, it is possible to reduce the size and cost of the liquid ejection apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail with reference to the following embodiments.

First Embodiment

Figure 1:
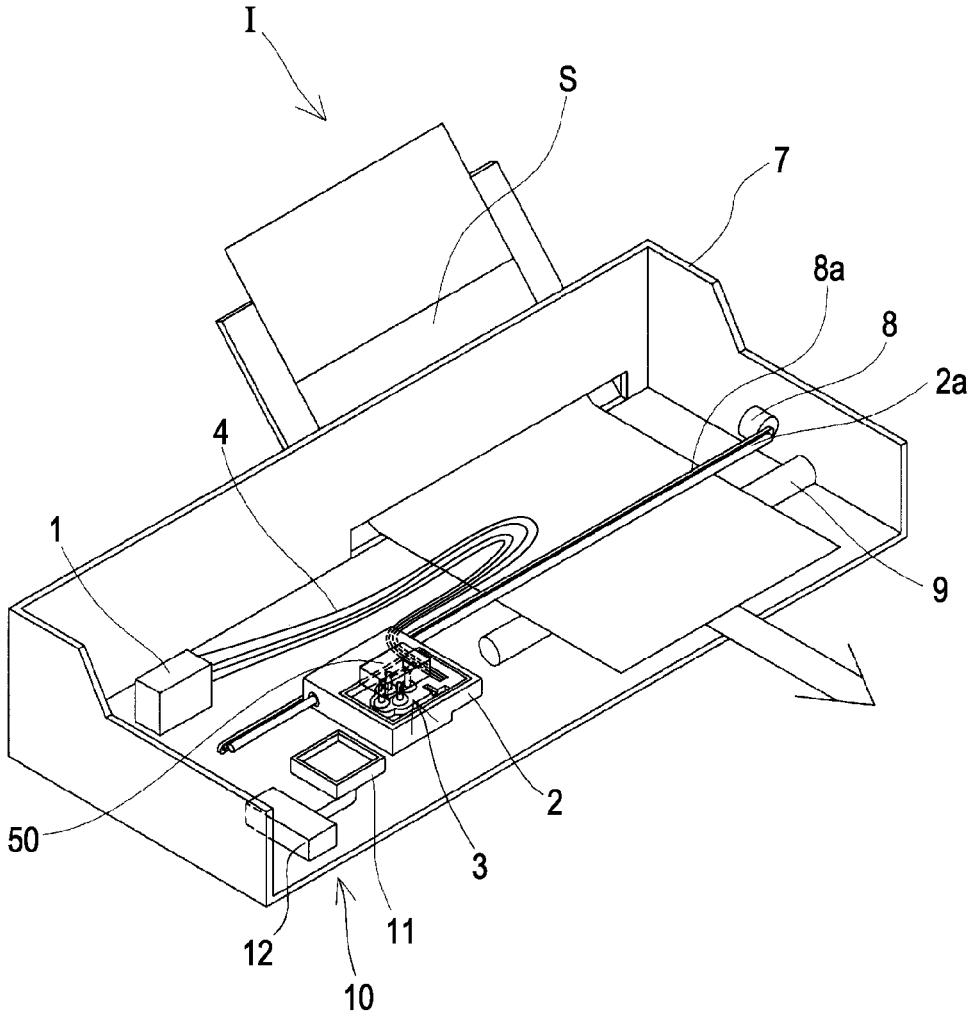
FIG. 1 is a schematic perspective view of a recording apparatus according to a first embodiment.

FIG. 1 is a schematic perspective view of an ink jet recording apparatus which is an example of liquid ejection apparatus according to a first embodiment of the invention.

As shown in FIG. 1, in this embodiment, ink which is a liquid stored in a liquid storing unit 1 is supplied to a ink jet recording head 3 which is an example of liquid ejecting head that is mounted on a carriage 2 via supply tubes 4.

The carriage 2 with the ink jet recording head 3 mounted thereon is disposed on a carriage shaft 2*a* that is secured to an apparatus body 7 so as to be movable in an axial direction of the carriage shaft 2*a*.

When a driving force from a drive motor 8 is transmitted to the carriage 2 via a plurality of gears which are not shown in the figure and a timing belt 8*a*, the carriage 2 on which the ink jet recording head 3 is mounted moves along the carriage shaft 2*a*. Further, a platen 9 is disposed along the carriage shaft 2*a* in the apparatus body 7 so that a recording sheet S which is a recording medium such as a sheet of paper that has been fed out, for example, by a sheet feeding roller (not shown in the figure) onto the platen 9 is transported.

An ink jet recording apparatus I such as that described above performs printing onto the recording sheet S by ejecting ink droplets from the ink jet recording head 3 while moving the carriage 2 along the carriage shaft 2*a*.

In the ink jet recording apparatus I, a suction unit 10 is disposed in a non-printing area which lies next to the platen 9 and at one end in a moving direction of the carriage 2. The suction unit 10 performs a suction operation for suctioning ink from nozzle openings on the ink jet recording head 3.

In the suction operation of the suction unit 10, the edge of a suction opening of a cap member 11 formed of a material such as a rubber is brought into contact with a liquid ejecting surface of the ink jet recording head 3 from which ink droplets are ejected. Then, a suction device 12 such as a suction pump performs the suction operation so as to apply a negative pressure to the inside of the cap member 11 so that ink in a liquid flow path of the ink jet recording head 3 is suctioned with air bubbles through nozzle openings. Moreover, the cap member 11 is configured to cover the nozzles at a timing when the suction operation is not performed, for example, during the power off state, stand-by state, or at regular timings, thereby preventing ink around the nozzles from being thickened due to drying.

Further, in the ink jet recording apparatus I, a pressing unit 50 is also disposed in the non-printing area which lies next to the platen 9 and at one end in the moving direction of the carriage 2.

In this embodiment, the pressing unit 50 is disposed on the same side of the non-printing area as the suction unit 10 is disposed. The pressing unit 50 is configured to press a specified position of the ink jet recording head 3 during the suction operation in which ink in the ink jet recording head 3 is suctioned by the suction unit 10. Accordingly, in this embodiment, the pressing unit 50 is disposed on the same side of the non-printing area as the suction unit 10 is disposed, and when the ink jet recording head 3 has moved to the non-printing area, the pressing unit 50 is located on the opposite side of the ink jet recording head 3 from the suction unit 10.

In the ink jet recording apparatus I, the liquid storing unit 1 such as an ink tank which contains ink is secured to the apparatus body 7 and connected to the ink jet recording head 3 via supply tubes 4 such as a flexible tube.

Figure 2:
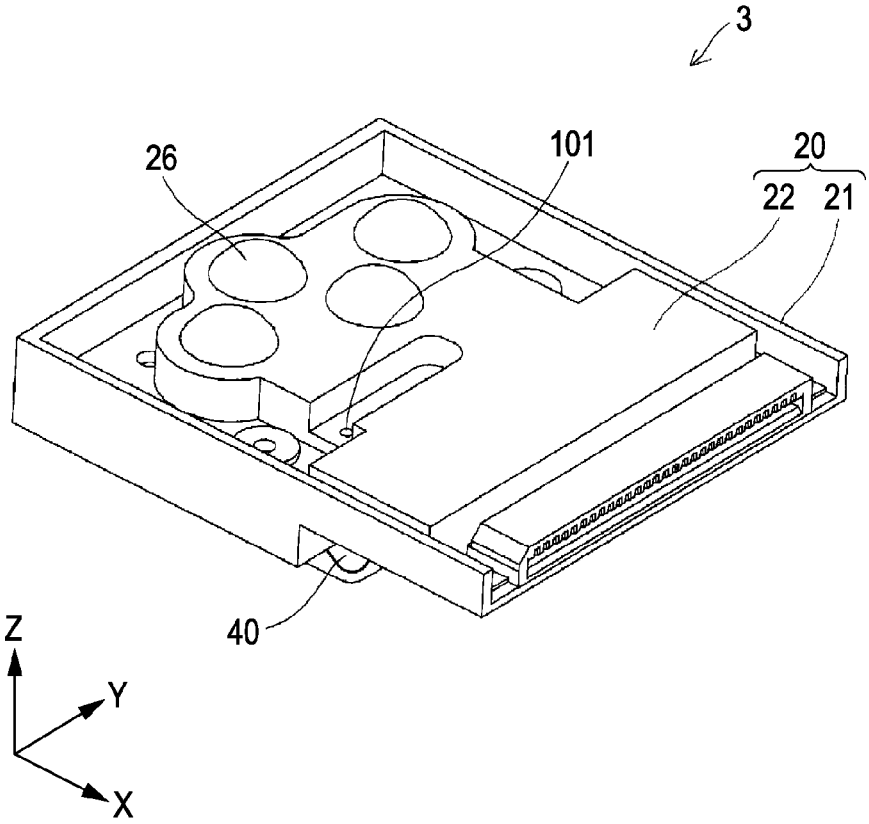
FIG. 2 is a perspective view of a recording head according to the first embodiment.
Figure 3A:
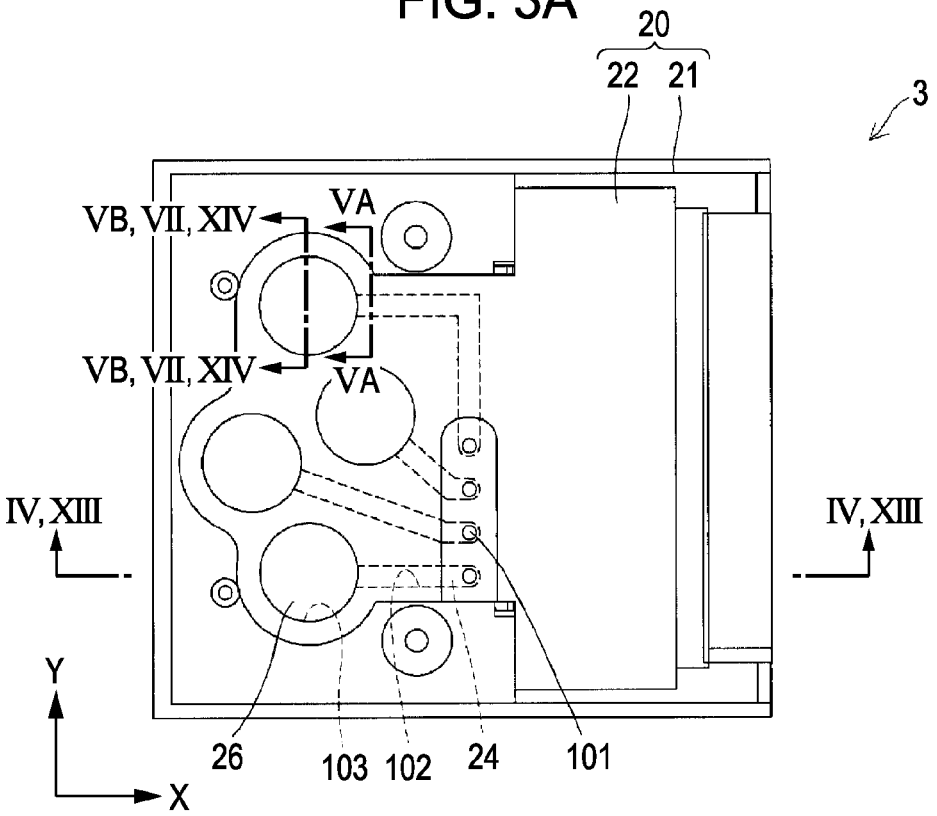
FIG. 3A is a top view of the recording head according to the first embodiment.
Figure 3B:
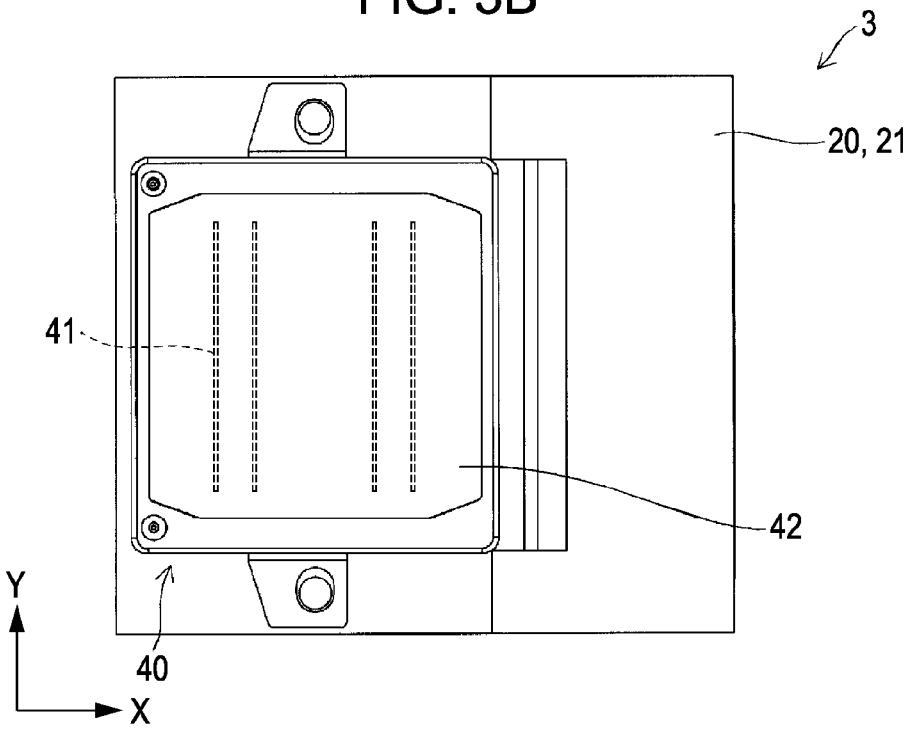
FIG. 3B is a bottom view of the recording head according to the first embodiment.
Figure 4:
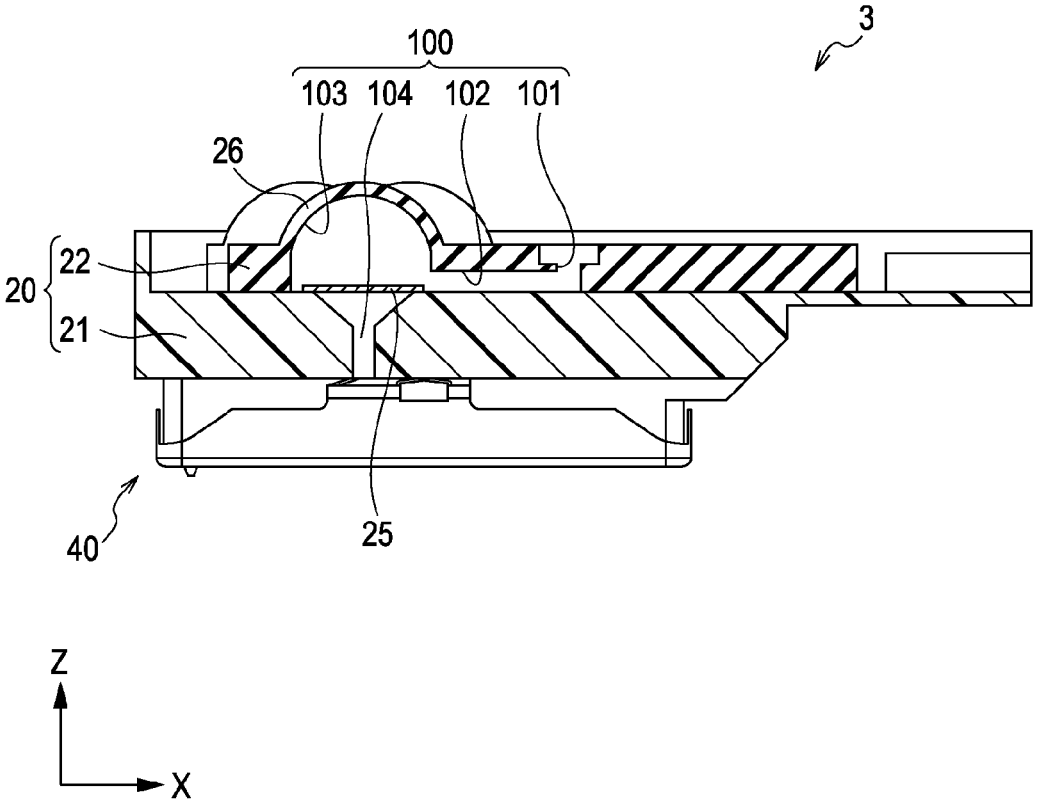
FIG. 4 is a sectional view of the recording head according to the first embodiment.
Figure 5A:
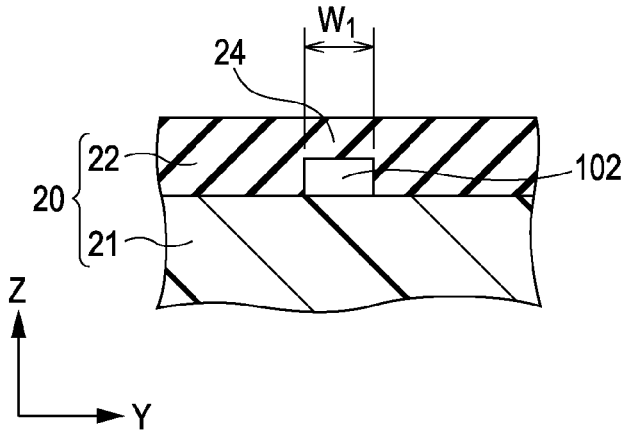
FIGS. 5A and 5B are sectional views of the recording head according to the first embodiment.
Figure 5B:
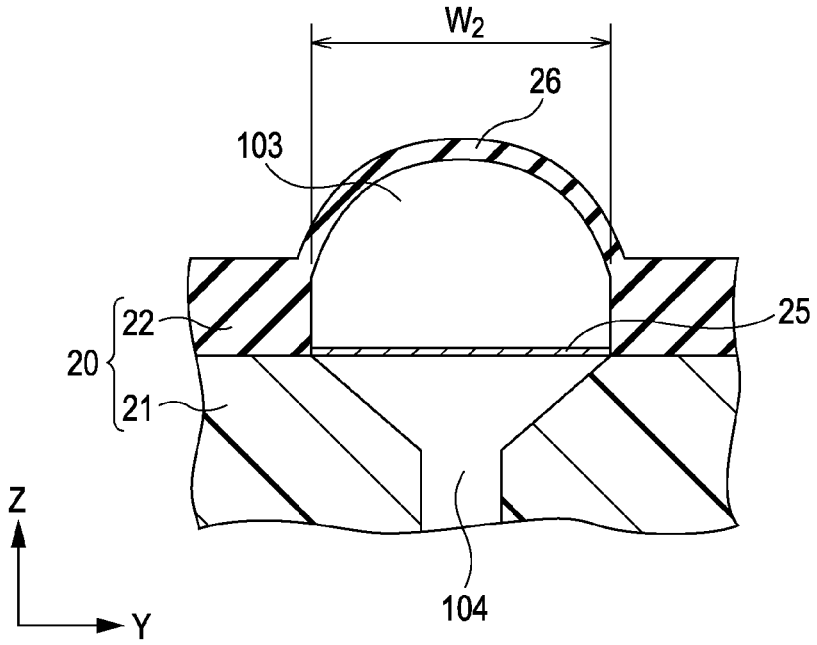

The ink jet recording head 3 that is mounted on the above-mentioned ink jet recording apparatus I will be described below. FIG. 2 is a perspective view of the ink jet recording head 3 according to the first embodiment of the invention. FIGS. 3A and FIG. 3B are a top view and a bottom view of the ink jet recording head 3 according to the first embodiment, respectively. FIG. 4 is a sectional view taken along the line IV-IV of FIG. 3A, and FIGS. 5A and 5B are sectional views taken along the line VA-VA and the line VB-VB of FIG. 3A, respectively.

As shown in the figures, the ink jet recording head 3 is connected to the liquid storing unit 1 via the supply tubes 4 (see FIG. 1) and includes a flow path member 20 through which ink is supplied from the liquid storing unit 1 and a head body 40 that is secured to the flow path member 20 such that ink is supplied from the flow path member 20 and ejected as ink droplets from the head body 40.

The head body 40 has a liquid ejection surface 42 on the side opposite to the surface secured to the flow path member 20. Nozzle openings 41 that are open to the liquid ejection surface 42 are formed such that ink as a liquid is ejected therethrough in the form of ink droplets. Further, although not shown in the figures, liquid flow paths which communicate with the respective flow paths in the flow path member 20 and extend to the nozzle openings 41 and pressure generating units that cause a pressure change of ink in the liquid flow paths are disposed inside the head body 40. Examples of such pressure generating units include those use a piezoelectric actuator formed of a piezoelectric material having an electromechanical conversion function that deforms to change the volume of the liquid flow path and causes a pressure change of ink in the liquid flow paths, thereby allowing ink droplets to be ejected from the nozzle openings 41, or those use a heat generating element disposed in the liquid flow path that generates bubbles by heat from the heat generating element, thereby allowing ink droplets to be ejected from the nozzle openings 41. Further, examples of the pressure generating units also include so-called electrostatic actuator that generates an electrostatic force between a vibration plate and an electrode so as to deform the vibration plate, thereby allowing ink droplets to be ejected from the nozzle openings 41.

In this embodiment, a plurality of nozzle openings 41 forms a nozzle line in a second direction Y on the head body 40, and four nozzle lines are arranged side by side in a first direction X which is perpendicular to the second direction Y such that different ink are ejected from each of the nozzle lines.

The flow path member 20 that supplies ink to the head body 40 as mentioned above includes a flow path member body 21 that is secured to the head body 40 and an elastic member 22 that is secured on the opposite side of the flow path member body 21 from the head body 40.

The flow path member body 21 is formed of a material having higher rigidity than that of the elastic member 22 such as a metal and resin. In this embodiment, for example, the flow path member body 21 may be made inexpensive by molding a resin material.

The elastic member 22 is formed of an elastically deformable material such as a rubber and elastomer. The elastically deformable material refers to a material that is elastically deformable so as to allow a second wall that forms a filter chamber which will be described in detail later to move toward and away from the filter.

The flow path member body 21 composed of the elastic member 22 and the flow path member 20 as described above is provided with liquid flow path 100. In this embodiment, since four nozzle lines each of which ejects different ink to the head body 40 are arranged, four independent liquid flow paths 100 each of which supplies different ink are formed in the flow path member 20.

One end of the liquid flow paths 100 is open to the surface of the elastic member 22 which is opposite to the head body 40 and communicates with each of the supply tubes 4 connected to the liquid storing unit 1. The other end of the liquid flow paths 100 is open to the surface which faces to the head body 40 and communicates with each of the liquid flow paths (not shown in the figure) in the head body 40.

Each liquid flow path 100 includes a connection port 101 that is connected to the supply tube 4, a first flow path 102 that communicates with the connection port 101, a filter chamber 103 that communicates with the first flow path 102, and a second flow path 104 that communicates with the filter chamber 103 and with the liquid flow path (not shown in the figure) in the head body 40.

The connection port 101 is formed so as to penetrate the elastic member 22 in the thickness direction (the direction Z in which the elastic member 22 and the flow path member body 21 are stacked).

As shown in FIG. 5A and FIG. 5B, the first flow path 102 and the filter chamber 103 are formed at a border between the flow path member body 21 and the elastic member 22. Specifically, the first flow path 102 is defined by a recess formed to be depressed from the surface of the elastic member 22 which is secured to the flow path member body 21, and a face of the flow path member body 21 (the surface which is secured to the elastic member 22) that seals the recess. That is, the first flow path 102 has a rectangular cross section, three sides of which are defined by the elastic member 22 and one side of which is defined by the flow path member body 21. The cross section of the first flow path is a section taken in the direction perpendicular to an ink flow direction. As a matter of course, the cross section of the first flow path 102 is not limited to a rectangular shape, and may be other shapes such as circular, elliptical and polygonal shapes.

In this embodiment, a wall of the first flow path 102 that is arranged opposite a wall formed by the flow path member body 21 is defined as a first wall 24. Further, in an area of the flow path member body 21 where the elastic member 22 is secured, a width of the first wall 24 in a direction (hereinafter, also simply referred to as a second direction Y) which is perpendicular to a flow direction of ink flowing in the first flow path 102 (hereinafter, also simply referred to as a first direction X) is defined as a first width $W_1$. That is, the first width $W_1$ of the first wall 24 in the second direction Y is a width of the first flow path 102 in the second direction Y.

The filter chamber 103 is defined by a recess formed on the surface of the elastic member 22 which faces to the flow path member body 21, and a face of the flow path member body 21 that faces to the elastic member 22. The filter chamber 103 has a width in the second direction Y larger than that of the first flow path 102.

Further, the filter chamber 103 also has a width in the first direction X larger than a width in the second direction Y of the first flow path 102.

Four filter chambers 103 are arranged on the flow path member body 21 side by side in the second direction Y. The filter chambers 103 adjacent in the second direction Y are arranged in positions partly overlapped with each other in the first direction X.

A filter 25 is disposed in each filter chamber 103 so as to remove foreign substances and air bubbles contained in ink. In this embodiment, the filter 25 is fixedly attached on the surface of the flow path member body 21 where the second flow path 104 is open, that is, on the side of the flow path member body 21 secured to the elastic member 22.

The filter 25 may be, for example, in the form of a sheet having a plurality of fine holes which is formed by finely braiding fibers of metal or resin, or a metal or resin plate in which a plurality of holes are formed penetrating the plate. Further, the filter 25 may also be formed of a non-woven fabric and may be made of any material.

The filter chamber 103 has a second wall 26 which is located at a position opposite the filter 25. The filter chamber 103 is made of the elastic member 22 and is elastically deformable. In this embodiment, the second wall 26 protrudes in a dome shape (a hemispherical shape) from the peripheral area (the remaining area of the elastic member 22) in the direction opposite to the filter 25. The dome shape as used herein refers to a shape having a protruding amount that gradually increases from the periphery to the center. Further, the second wall 26 of this embodiment is disposed so as to completely cover the filter 25 which is positioned opposite the second wall 26, extending over the area slightly larger than the filter 25.

A width of the second wall 26 which forms the filter chamber 103 in the second direction Y, that is, a width (a second width $W_2$) of the flow path member body 21 in an area where the elastic member 22 is secured in a direction (the second direction Y) which is perpendicular to the flow direction of ink flowing in the first flow path 102 (the first direction X), is larger than the first width $W_1$ of the first wall 24.

Further, a thickness (in the direction Z) of the second wall 26 which forms the filter chamber 103 is smaller than a thickness of the first wall 24 which forms the first flow path 102.

Since the width $W_2$ of the second wall 26 which forms the filter chamber 103 is larger than the width $W_1$ of the first wall 24 and the thickness of the second wall 26 is smaller than that of the first wall 24, the second wall 26 which forms the filter chamber 103 has a rigidity lower than that of the first wall 24 which forms the first flow path 102. That is, in this embodiment, since the second width $W_2$ of the second wall 26 is larger than the first width $W_1$ of the first wall 24, a distance between side walls that support the second wall 26 becomes short in the area of the first wall 24. Accordingly, the second wall 26 has a rigidity lower than that of the first wall 24, that is, the second wall 26 is easy to elastically deform toward the filter 25. Moreover, since the thickness of the second wall 26 is smaller than that of the first wall 24, the second wall 26 has a rigidity lower than that of the first wall 24, that is, the second wall 26 is easy to elastically deform toward the filter 25. The rigidity as used herein refers to the degree of resistance to change in dimension (deformation) when a force is applied and is represented by a force required to induce a unit deformation (load/deformation amount). Particularly, in this embodiment, the rigidity at a substantial center of the first wall 24 and at a substantial center of the second wall 26 are compared.

The second flow path 104 is formed so as to penetrate the flow path member body 21 in the thickness direction (the direction Z in which the elastic member 22 and the flow path member body 21 are stacked). One end of the second flow path 104 is open to the surface of the flow path member body 21 which is secured to the elastic member 22 and communicates with the filter chamber 103, while the other end of the second flow path 104 is open to the surface of the flow path member body 21 opposite to the surface which is secured to the elastic member 22 and communicates with the flow path (not shown in the figure) in the head body 40.

In the ink jet recording head 3, ink is supplied from the liquid storing unit 1 through the supply tubes 4 to the flow path member 20. Then, ink flows through the connection ports 101, the first flow paths 102, the filter chambers 103 and the second flow paths 104, all of which constitute the liquid flow paths 100 of the flow path member 20, and is supplied to the head body 40. When the liquid flow path of the head body 40 is filled with ink up to the nozzle openings 41, the pressure generating units are actuated to eject ink droplets from the nozzle openings 41 in response to a recording signal from the external device.

In this embodiment, the ink jet recording head 3 is mounted on the ink jet recording apparatus I such that the first direction X is consistent with the moving direction of the carriage 2.

Figure 7A:
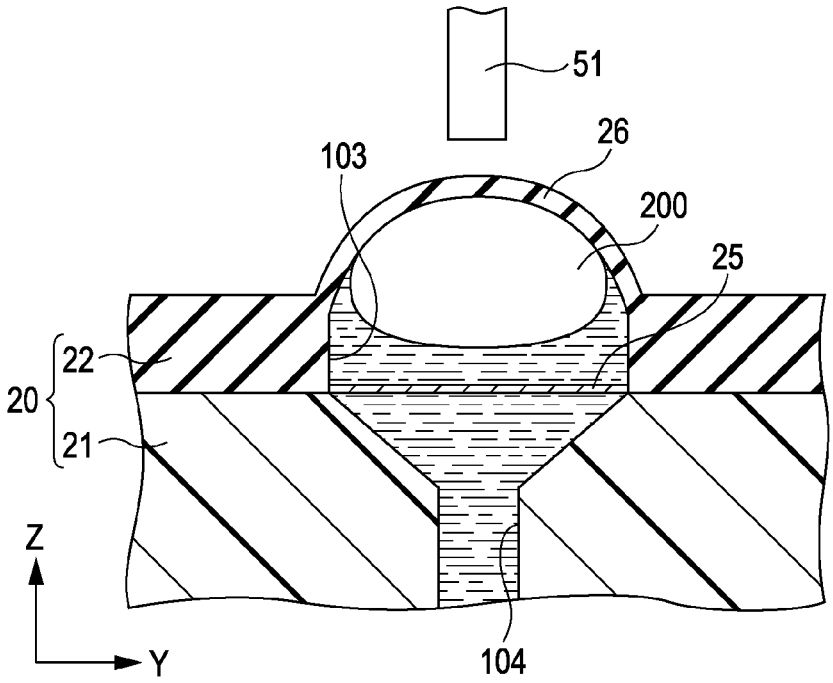
FIGS. 7A and 7B are sectional views which show an operation of the pressing unit according to the first embodiment.

In the flow path member 20 according to this embodiment, air bubbles contained in ink is trapped by the filter 25 and collected in the filter chamber 103 as air bubbles 200 as shown in FIG. 7A. When the air bubbles 200 trapped by the filter 25 grow, they start to cover the filter 25. As a result, an effective area of the filter 25 that allows ink to pass through is reduced, thereby increasing a pressure loss and causing ejection failure of ink droplets which are ejected from the head body 40. Therefore, the air bubbles 200 collected in the filter chamber 103 are need to be discharged to the outside of the ink jet recording head 3 at predetermined timings.

In this embodiment, the air bubbles 200 collected in the filter chamber 103 are discharged together with ink from the nozzle openings 41 to the outside of the ink jet recording head 3 by suctioning ink in the ink jet recording head 3 from the nozzle openings 41 by using the suction unit 10 while pressing the second wall 26 made of the elastic member 22 of the ink jet recording head 3 by using the pressing unit 50.

Figure 6:
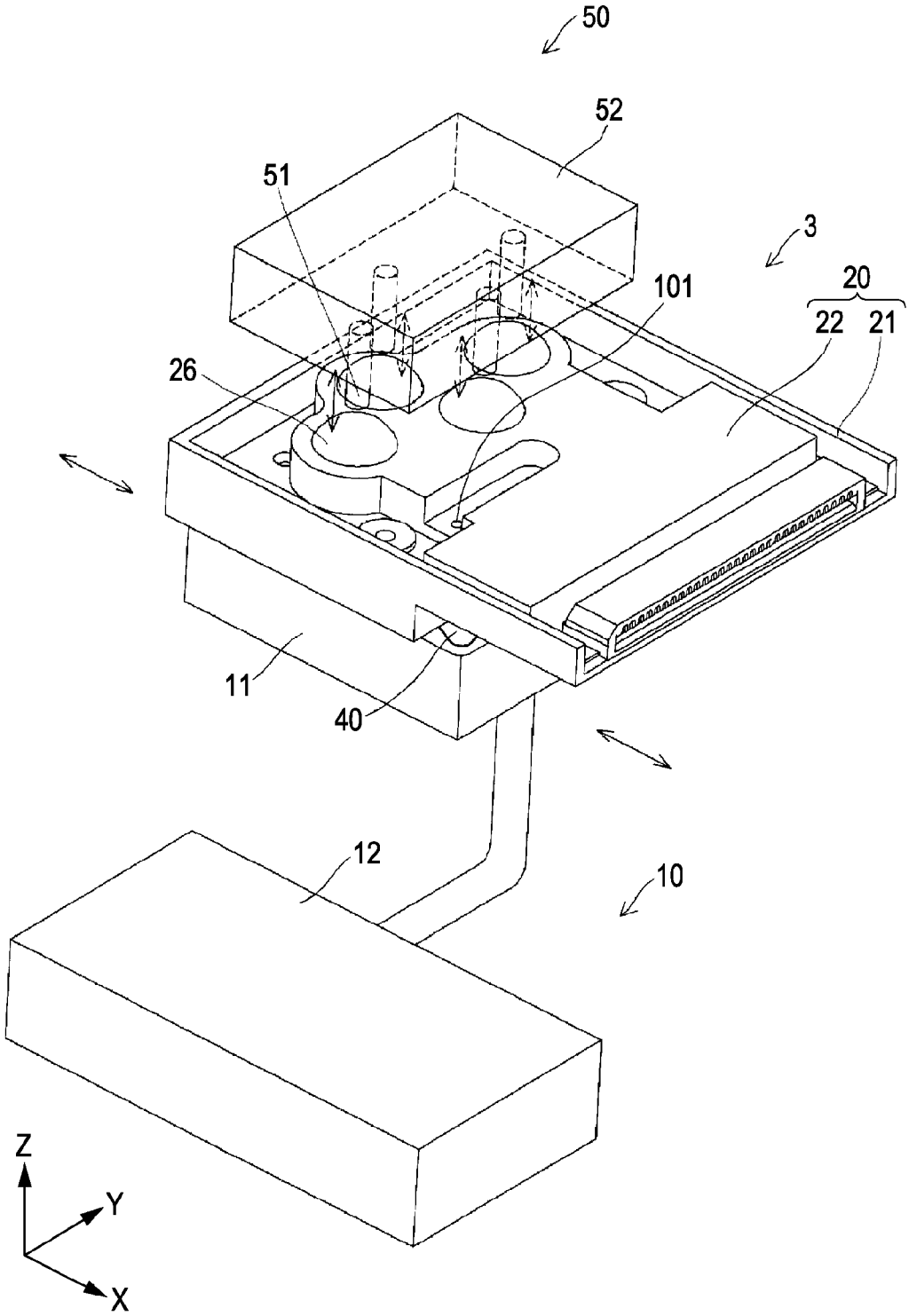
FIG. 6 is a perspective view of the recording head and a pressing unit according to the first embodiment.
Figure 7B:
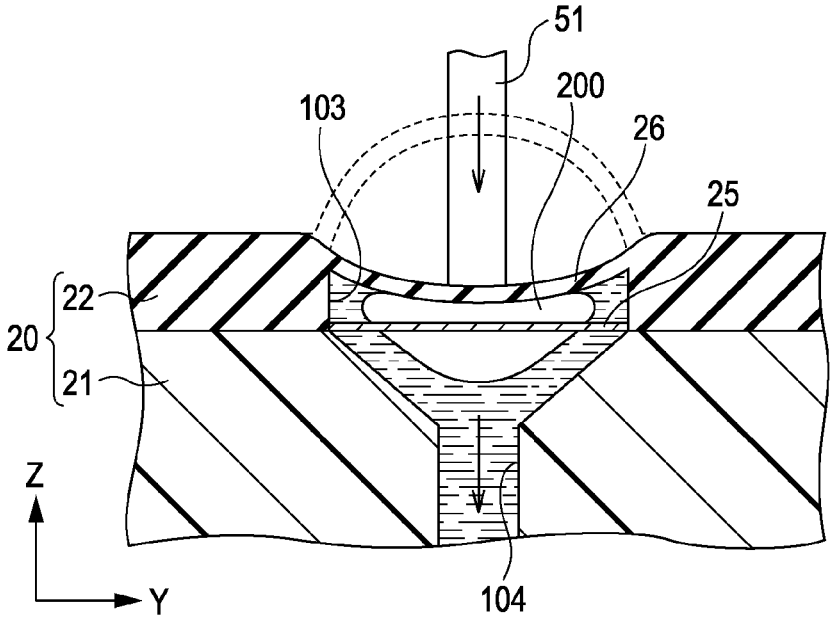

The pressing unit 50 will be described below with reference to FIGS. 1, 6, 7A and 7B. FIG. 6 is a perspective view of the pressing unit 50, the ink jet recording head 3 and the suction unit 10 according to the first embodiment. FIGS. 7A and 7B are sectional views taken along the line VII-VII of FIG. 3A in which the pressing unit 50 is in a pressed state.

As shown in FIG. 1, the pressing unit 50 is mounted in the apparatus body 7 at a position in the non-printing area of the ink jet recording apparatus I such that the pressing unit 50 opposes the flow path member 20 of the ink jet recording head 3 when the ink jet recording head 3 has moved to the non-printing area.

Specifically, the pressing unit 50 is disposed at a position in which the pressing unit 50 can press the second wall 26 of the ink jet recording head 3 while the suction unit 10 suctions ink in the ink jet recording head 3 from the nozzle openings 41. Accordingly, in this embodiment, the pressing unit 50 is disposed on the same side of the non-printing area as the suction unit 10 is disposed, and when the ink jet recording head 3 has moved to the non-printing area, the pressing unit 50 is located on the opposite side of the ink jet recording head 3 from the suction unit 10.

The pressing unit 50 includes a plurality of pressing pins 51 and a driving unit 52 that holds the proximal end of the plurality of pressing pins 51, as shown in FIG. 6.

Four pressing pins 51 are provided corresponding to the respective liquid flow paths 100 of the flow path member 20 with the distal end of the pressing pins 51 facing to the second wall 26 that forms the filter chamber 103.

The driving unit 52 is configured to move the four pressing pins 51 independently from each other in the axial direction (Z direction). The driving unit 52 may include, for example, that uses a driving motor or electromagnet to generate a driving force to move the pressing pins 51.

The pressing pin 51 of the pressing unit 50 does not press the second wall 26 when it is in a state shown in FIG. 7A. When the pressing pin 51 of the pressing unit 50 moves to a state shown in FIG. 7B, it presses the second wall 26 so as to elastically deform the second wall 26 toward the filter 25. In this state, the air bubbles 200 collected in the filter chamber 103 are pressed against the filter 25 by the elastically deformed second wall 26, and then discharged downstream through the filter 25 into the second flow path 104. Then, as the suction unit 10 suctions ink from the nozzle openings 41, the air bubbles 200 that have passed through the filter 25 are suctioned together with ink from the nozzle openings 41 and then discharged to the outside of the ink jet recording head 3.

Since the suction unit 10 suctions the air bubbles 200 while the pressing unit 50 presses the air bubbles 200 downstream from the filter 25, it is possible to reliably discharge the air bubbles 200 collected in the filter chamber 103 to the outside of the ink jet recording head 3 even when a suction pressure from the suction unit 10 is low. Accordingly, it is possible to prevent an excessive consumption of ink and to use a small inexpensive suction unit that operates with a relatively low pressure as the suction device 12 of the suction unit 10. If the pressing unit 50 and the second wall 26 which can be elastically deformable are not provided, the suction unit 10 is required to have a significantly increased suction force to suction the air bubbles 200 trapped on the filter 25 passing through the filter 25, which causes an excessive consumption of ink and a need of large expensive suction device 12 having a high suction force.

Although the second wall 26 can be elastically deformed toward the filter 25 by using only the suction unit 10 that suctions ink from the nozzle openings 41 without using the pressing unit 50, this embodiment uses the pressing unit 50 that presses the second wall 26 in addition to the suction unit 10 that suctions ink from the nozzle openings 41. With this configuration, it is possible to use a smaller, less expensive suction unit 10 (the suction device 12) having a lower suction force compared with the case in which the second wall 26 is elastically deformed by using only the suction unit 10.

When pressing of the second wall 26 by the pressing unit 50 is released and the suction operation for suctioning ink from the nozzle openings 41 by the suction unit 10 is terminated, the second wall 26 that has been elastically deformed toward the filter 25 returns to its original state, that is, being away from the filter 25 as shown in FIG. 7A.

As described above, the ink jet recording apparatus I according to this embodiment is configured such that the pressing unit 50 presses the second wall 26 while the suction unit 10 suctions ink from the nozzle openings 41 in order to discharge the air bubbles 200 trapped on the filter 25 to the outside of the ink jet recording head 3. However, the air bubbles 200 may also be trapped by the filter 25, for example, during filling of ink by replacing the liquid storing unit 1 with new one, or so-called initial filling of ink in which ink is supplied from the liquid storing unit 1 to the liquid flow path 100 which is not filled with ink until it becomes to be filled with ink up to the nozzle openings 41 of the ink jet recording head 3. Accordingly, by pressing the second wall 26 toward the filter 25 by using the pressing unit 50 while suctioning ink during replacement of the liquid storing unit 1 or during initial filling of ink, it is possible to perform the suction operation during replacement of the liquid storing unit 1 or during initial filling of ink by using the suction unit 10 (the suction device 12) having a low suction force.

Moreover, the operation of the pressing unit 50 and the operation of the suction unit 10 can be controlled, for example, by a control circuit which is not shown in the figure that controls a moving position of the carriage 2 in a main scan direction, or alternatively, by transmitting a mechanical movement such as attachment and/or removal of the liquid storing unit 1 and opening and/or closing of a sheet tray in a mechanical manner.

In this embodiment, since the pressing unit 50 can independently press each second wall 26 of the filter chambers 103, cleaning can be performed only in the liquid flow path 100 in which the air bubbles 200 are stagnant. As a result, it is possible to prevent an excessive consumption of ink by suctioning ink in the liquid flow path 100 that does not need to be cleaned.

Further, in this embodiment, both the second wall 26 that forms the filter chamber 103 and the first wall 24 that forms the first flow path 102 which is a liquid flow path upstream with respect to the filter chamber 103 are made of the elastic member 22, and the second wall 26 is made to have a rigidity lower than that of the first wall 24. Accordingly, the second wall 26 and the first wall 24 can be made of the same material without assembling. Therefore, it is possible to reduce the number of components, save the manufacturing cost related to materials and assembling, and achieve downsizing compared with the case in which the second wall 26 is made of the elastic member 22 and the remaining area including the first wall 24 is formed of a material other than that of the elastic member 22.

In this embodiment in which the first wall 24 and the second wall 26 are made of the elastic member 22, the first wall 24 is less likely to deform toward the flow path member body 21 (has a higher rigidity) when pressed by the pressing unit 50. This prevents the suction force from being reduced during the suction operation of the suction unit 10. If the first wall 24 is elastically deformed toward the flow path member body 21 during the suction operation of the suction unit 10, the cross section of the flow path of the first flow path 102 becomes small, which may increase a resistance of the flow path and reduce the suction force of the suction unit 10.

Second Embodiment

Figure 8A:
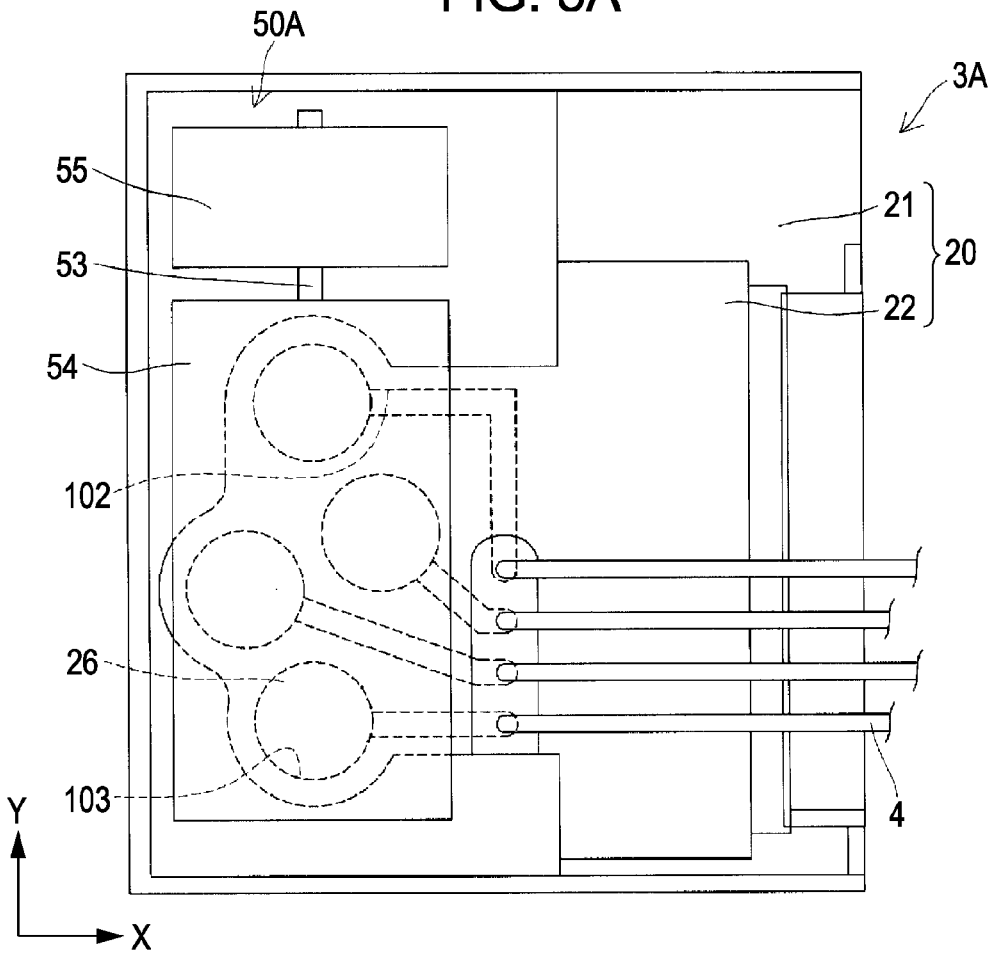
FIG. 8A is a top view of a liquid ejecting head according to a second embodiment.
Figure 8B:
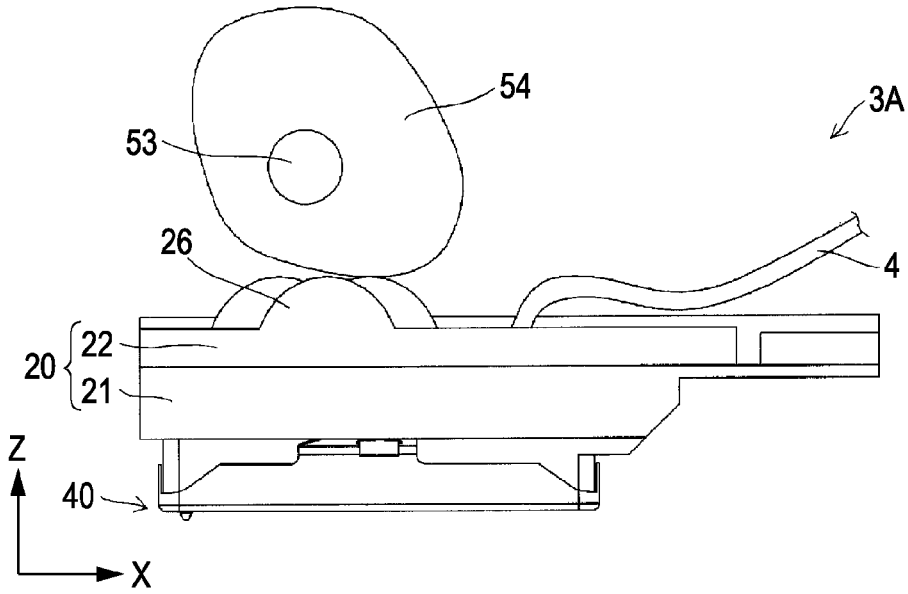
FIG. 8B is a side view of the liquid ejecting head according to the second embodiment.
Figure 9A:
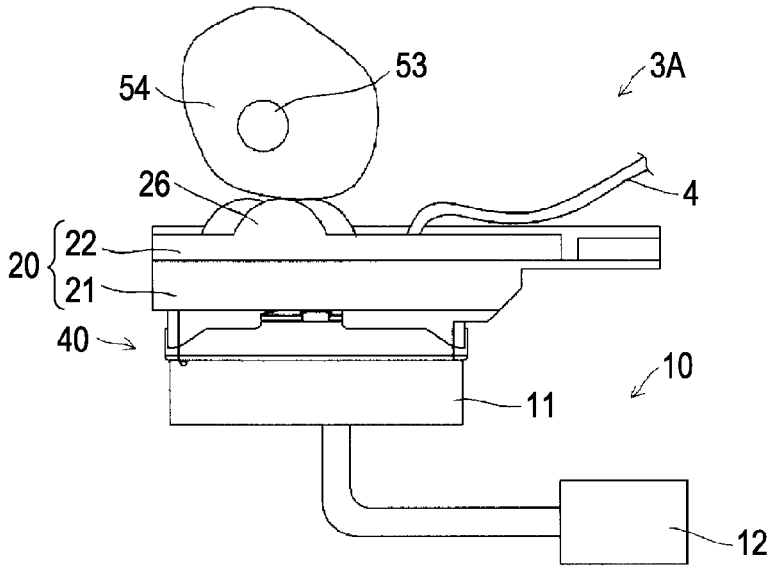
FIGS. 9A and 9B are side views which show an operation of a pressing unit according to the second embodiment.
Figure 9B:
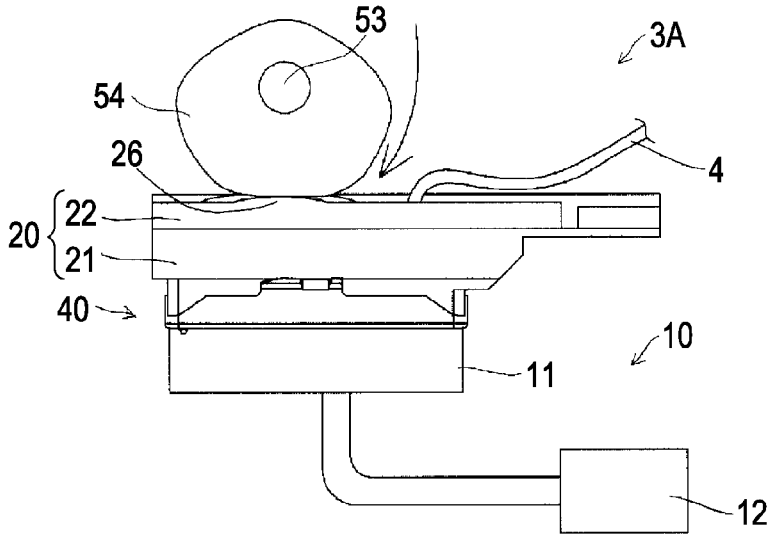

FIGS. 8A and 8B are a top view and a side view of an ink jet recording head, respectively, as an example of liquid ejecting head according to the second embodiment of the invention. FIGS. 9A and 9B are side views which show an operation of the ink jet recording head according to the second embodiment. The similar components as the first embodiment are designated by the same reference numerals and will not be further described.

As shown in the figures, an ink jet recording head 3A according to the second embodiment includes the flow path member 20, the head body 40 and a pressing unit 50A. That is, although the pressing unit 50 is provided in the ink jet recording apparatus I in the first embodiment, the pressing unit 50A is provided in the ink jet recording head 3A in the second embodiment.

Specifically, the flow path member 20 and the head body 40 have the same configuration as the first embodiment.

The pressing unit 50A includes a pressing rotation shaft 53, a pressing cam 54 which is an eccentric cam that is held in an eccentric state at one end of the pressing rotation shaft 53, and a pressing driving unit 55 such as a motor that is disposed at the other end of the pressing rotation shaft 53 and rotates the pressing rotation shaft 53.

The pressing cam 54 according to the second embodiment is disposed at a position opposite the second wall 26 of the flow path member 20 so as to extend over a plurality of the second walls 26. That is, the pressing cam 54 according to the second embodiment is sized to be capable of pressing all the four second walls 26.

The pressing cam 54 of the pressing unit 50A does not press the second wall 26 when it is in a state shown in FIG. 9A. When the pressing driving unit 55 drives to rotate the pressing rotation shaft 53 and thereby rotating the pressing cam 54 as shown in FIG. 9B, the pressing cam 54 can press the second walls 26. Accordingly, the pressing cam 54 is positioned and has an amount of eccentricity such that the pressing cam 54 moves between the state of pressing the second walls 26 and the state of releasing the pressing of the second walls 26 by its rotation.

Further, the pressing driving unit 55 according to the second embodiment is held on the flow path member body 21 of the flow path member 20. As a matter of course, the pressing driving unit 55 may be mounted on the carriage 2.

Although one pressing cam 54 is provided for a plurality of (four) second walls 26 in the second embodiment, it is not limited thereto and the pressing cam 54 may be provided for each second wall 26. In this case in which the pressing cam 54 is provided for each second wall 26, the pressing driving unit 55 that drives the pressing cam 54 may also be provided for each pressing cam 54.

In the ink jet recording head 3A, cleaning of the ink jet recording head 3A can be performed in the same manner as described in the first embodiment by suctioning ink together with the air bubbles 200 from the nozzle openings 41 by using the suction unit 10 while pressing the second walls 26 by using the pressing unit 50A.

Third Embodiment

Figure 10:
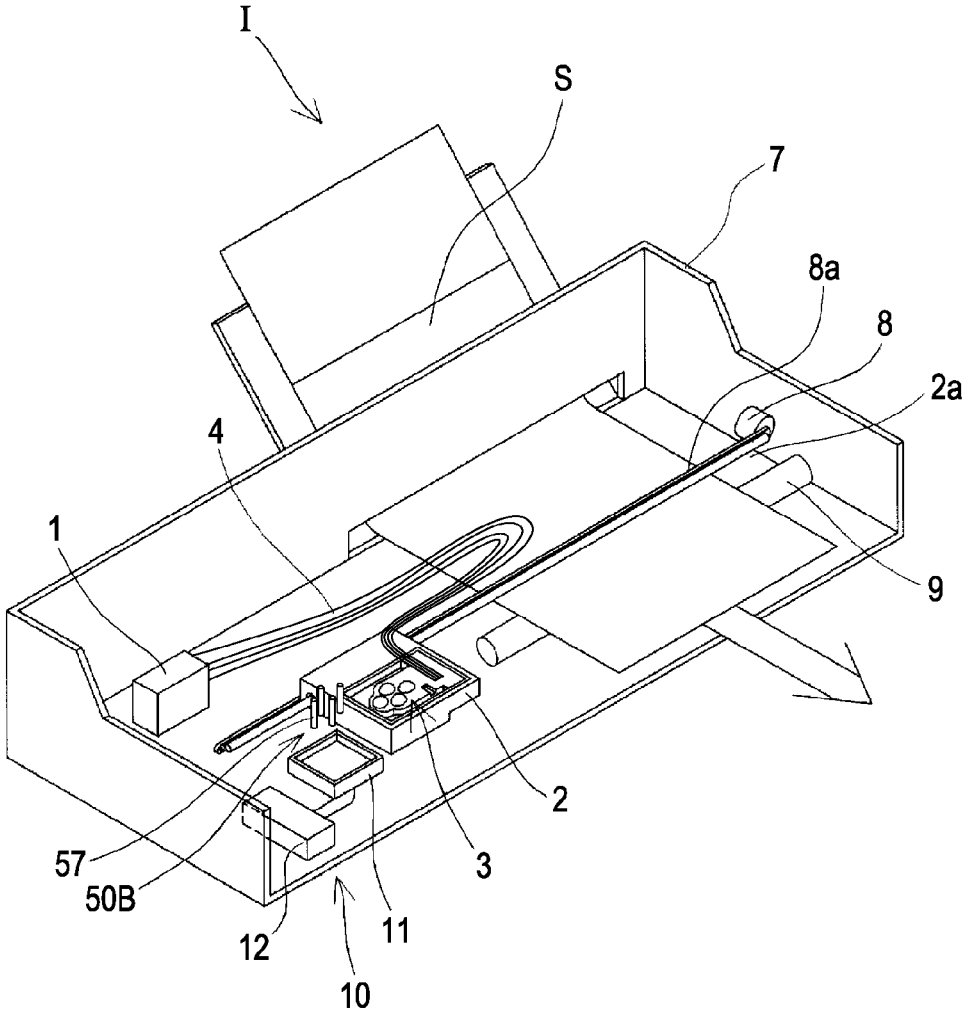
FIG. 10 is a schematic perspective view of a recording apparatus according to a third embodiment.
Figure 11A:
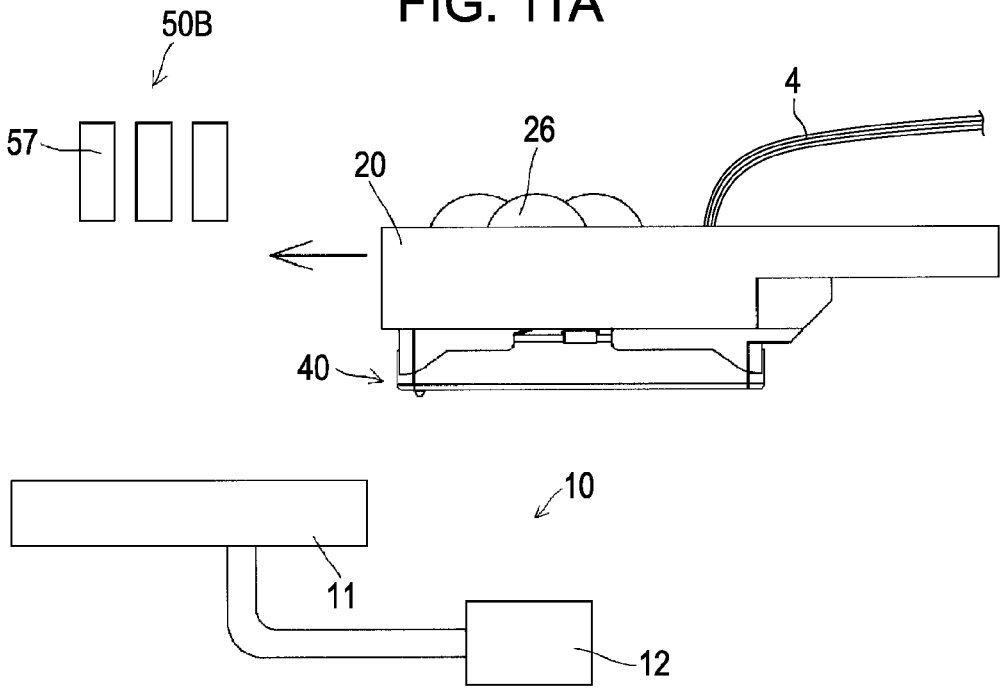
FIGS. 11A and 11B are side views which show an operation of a pressing unit according to the third embodiment.
Figure 11B:
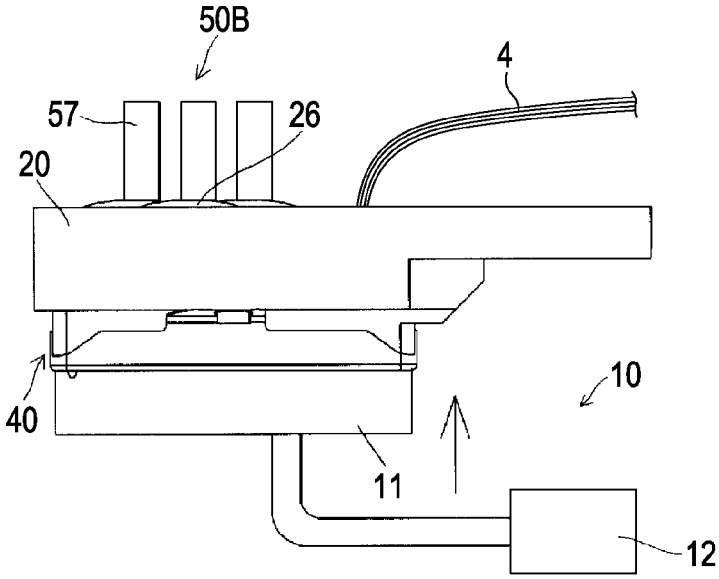
Figure 12A:
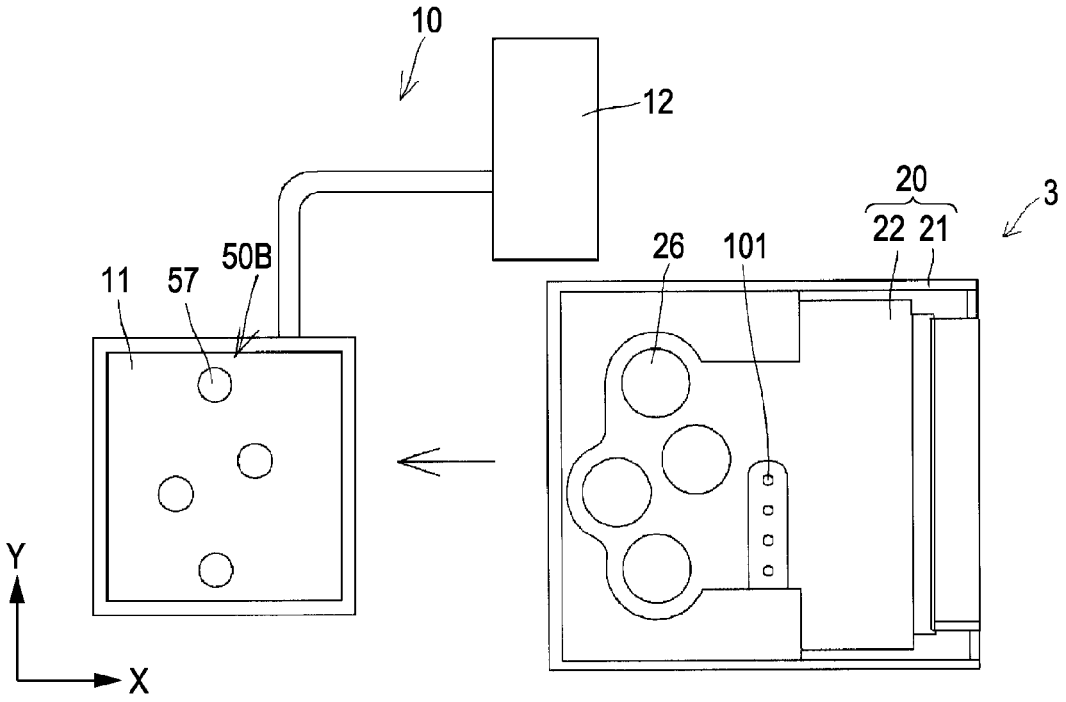
FIGS. 12A and 12B are top views which show an operation of the pressing unit according to the third embodiment.
Figure 12B:
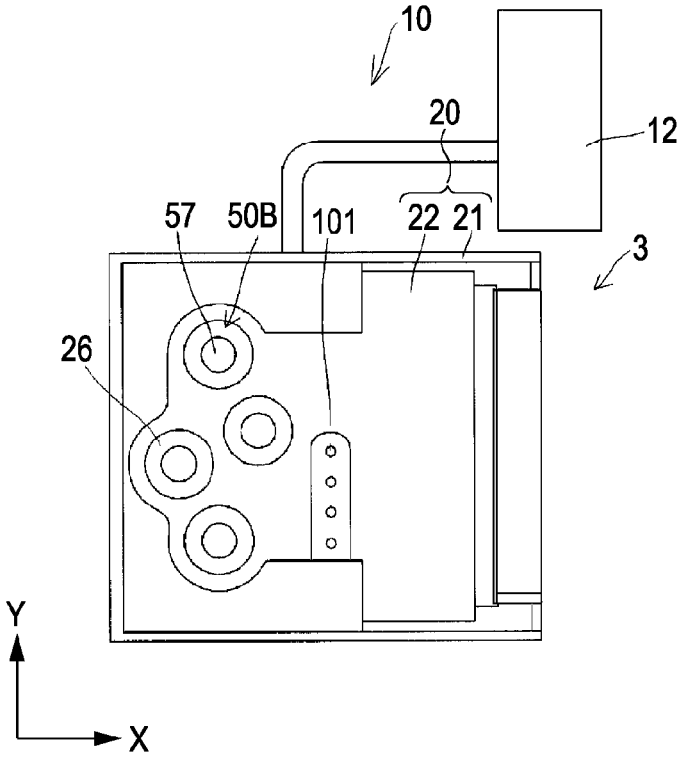

FIG. 10 is a schematic perspective view of an ink jet recording apparatus as an example of liquid ejection apparatus according to the third embodiment of the invention. FIGS. 11A and 11B are side views of an ink jet recording head which show an operation of a pressing unit. FIGS. 12A and 12B are top views of the ink jet recording head which show an operation of the pressing unit. The similar components as the first and second embodiments are designated by the same reference numerals and will not be further described.

As shown in the figures, the ink jet recording apparatus I according to the third embodiment is configured such that the carriage 2 moves in the main scan direction similarly to the ink jet recording apparatus I of the first embodiment shown in FIG. 1.

In the ink jet recording apparatus I, a pressing unit 50B is provided in a non-printing area which is outside the printing area.

The pressing unit 50B includes a plurality of fixed pins 57 that are fixedly provided in the apparatus body 7. The fixed pins 57 are arranged such that the distal end of the fixed pins 57 comes into contact with each of the second walls 26 of the ink jet recording head 3 when the carriage 2 moves in the main scan direction and reaches the non-printing area. With this configuration, the fixed pins 57 can abut against the second walls 26 so as to move the second walls 26 toward the filter 25 only with the movement of the ink jet recording head 3 to the non-printing area.

In the third embodiment, four fixed pins 57 are provided corresponding to the respective liquid flow paths 100.

Further, in the third embodiment, the ink jet recording head 3 is mounted on the carriage 2 such that the first direction X is consistent with the moving direction of the carriage 2 similarly to the first embodiment. Since four filter chambers 103 of the ink jet recording head 3 are arranged side by side in the second direction Y, the second walls 26 that are formed to correspond to the filter chambers 103 are also arranged side by side in the second direction Y. Accordingly, when four fixed pins 57 press the second walls 26 by movement of the carriage 2, each fixed pin 57 can press one of the second walls 26 without pressing any other second wall 26 that is pressed by other fixed pin 57.

Other Embodiments

Figure 13:
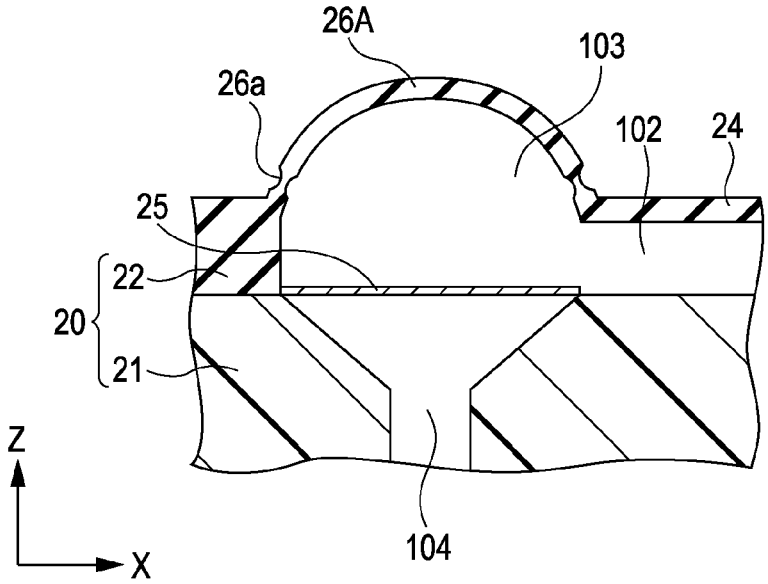
FIG. 13 is a sectional view of an essential part of a recording head according to other embodiment.

Although the embodiments of the invention have been described, the essential configuration of the invention is not limited thereto. For example, in the above described embodiments, the second width $W_2$ of the second wall 26 is described as being larger than the first width $W_1$ of the first wall 24 so that the second wall 26 has a rigidity lower than that of the first wall 24. However, the invention is not limited thereto as long as the second wall 26 has a rigidity lower than that of the first wall 24. For example, the area of the second wall 26 may be made of a material having a rigidity lower than that of the other area (the first wall 24). Such an example is shown in FIG. 13. FIG. 13 is a sectional view of an essential part of the flow path member according to other embodiment of the invention, which corresponds to a sectional view taken along the line XIII-XIII of FIG. 3A.

As shown in FIG. 13, a second wall 26A has a thin-walled section 26*a* which has a partially reduced thickness at a border with a peripheral flat surface. Accordingly, a rigidity lower than the first wall 24 can be achieved by forming a thin-walled section 26*a* in the second wall 26A. In the example illustrated in FIG. 13, the second width $W_2$ of the second wall 26A is larger than the first width $W_1$ of the first wall 24 similarly to the first embodiment. Accordingly, by adding the thin-walled section 26*a* to the second wall 26A, the second wall 26A can be made more easily deformable compared with the second wall 26 of the first embodiment. As a matter of course, even when the second width $W_2$ of the second wall 26A is the same as the first width $W_1$ of the first wall 24, the second wall 26A has a rigidity lower than the first wall 24 since the thickness of the second wall 26A is smaller than that of the first wall 24.

Figure 14A:
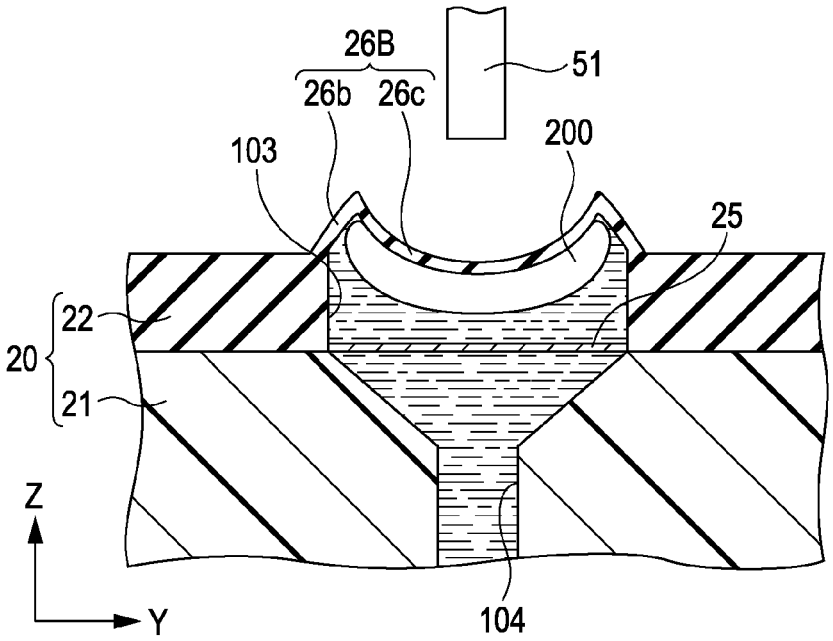
FIGS. 14*a* and 14B are sectional views of an essential part of the recording head according to other embodiment.
Figure 14B:
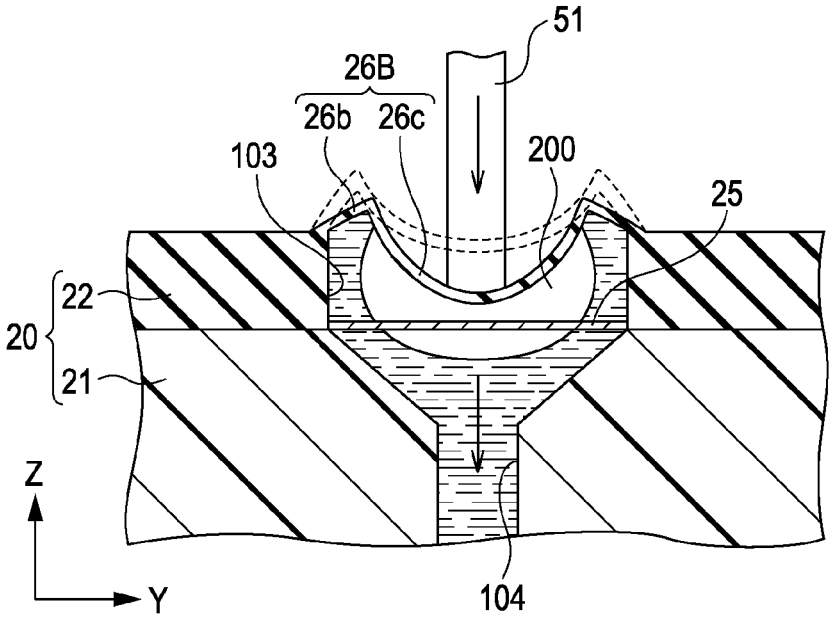

Further, although the second wall 26 is formed in a dome shape in the above embodiments, the form of the second wall 26 is not limited thereto. Other example of the second wall 26 is shown in FIGS. 14A and 14B. FIGS. 14A and 14B are sectional views of an essential part of the flow path member according to other embodiment of the invention, which corresponds to a sectional view taken along the line XIV-XIV of FIG. 3A.

As shown in FIGS. 14A and 14B, the second wall 26B includes a peripheral area 26*b* formed on the periphery, that is, peripheral flat surface, so as to protrude on the side opposite to the filter 25 and is inclined in a direction away from the filter 25, and a center area 26*c* formed in the center of the peripheral area 26*b* so as to protrude in a dome shape toward the filter 25.

In the second wall 26B, when the pressing unit 50, 50A and 50B press the second walls 26B, each center area 26*c* of the second walls 26B is elastically deformed toward the filter 25 as shown in FIG. 14B. Then, the second wall 26B that is elastically deformed is biased by the peripheral area 26*b* in the direction opposite to the filter 25. Accordingly, when pressing of the pressing units 50, 50A and 50B is released, the second wall 26B easily returns to the state shown in FIG. 14A. That is, when the second wall 26B is formed in such a shape, the second wall 26B can be easily deformed toward the filter 25 by using the pressing units 50, 50A and 50B, and can easily return to the original state away from the filter 25 by releasing the pressing of the pressing units 50, 50A and 50B.

In addition, it is also possible to make the second wall 26B to be more easily deformable by reducing all or part of the thickness of the second wall 26B in the same manner as shown in FIG. 13.

The ink jet recording heads 3, 3A described in the above embodiments include the flow path member 20, the head body 40, and the flow path member 20 having the flow path member body 21 as a base and the elastic member 22. However, the invention is not limited thereto and, for example, the flow path member body 21 that forms the flow path member 20 and the head body 40 may be formed integrally. That is, the flow path member body 21 and the head body 40 may be formed integrally having one side as a base on which the elastic member 22 is fixedly attached.

Further, although the first flow paths 102 and the filter chambers 103 are formed on the elastic member 22 as a channel (recess) in the above embodiments, the invention is not limited thereto. The first flow paths 102 and the filter chambers 103 can be formed as a channel (recess) on the side of the flow path member body 21, and the elastic member 22 in a plate shape can be used to seal the channel of the flow path member body 21. As a matter of course, channels can be formed on both the flow path member body 21 and the elastic member 22 so as to provide the first flow paths 102 and the filter chambers 103 at a border therebetween.

Further, although the flow path member 20 described in the above embodiments has the filter 25 only, it is also possible to provide a valve in the flow path member 20 so as to open and close the flow path at a predetermined pressure. Alternatively, a heating unit such as a heater may be provided.

Further, although the ink jet recording apparatus I of the above embodiment is described as having the ink jet recording head 3 that is mounted on the carriage 2 and moves in the main scan direction, the invention is not specifically limited thereto. For example, the invention is also applicable to a so-called line type recording apparatus in which the ink jet recording heads 3, 3A are provided at a fixed position and printing is performed by transporting the recording sheet S such as a sheet of paper in a sub-scan direction. Further, the invention is also applicable to an ink jet recording apparatus in which the liquid storing unit 1 is mounted on the carriage 2 and moves with the ink jet recording heads 3, 3A in the main scan direction.

Further, the invention is generally directed to liquid ejection apparatuses having a liquid ejection head, and may be applied to liquid ejection apparatuses, for example, recording heads such as various ink jet recording heads used for image recording apparatuses for printers and the like, color material ejecting heads used for manufacturing of the color filters for liquid crystal displays and the like, organic EL displays, electrode material ejecting heads used for forming electrode such as field emission displays (FED), and bioorganic ejecting heads used for manufacturing bio chips and the like.

The entire disclosure of Japanese Patent Application No. 2012-010508, filed Jan. 20, 2012 is incorporated by reference herein.

What is claimed is:

1. A liquid ejection apparatus comprising:

a liquid ejecting head having a head body that ejects liquid from nozzle openings and a flow path member that includes a liquid flow path through which the liquid is supplied to the head body, the liquid flow path being provided with a filter chamber disposed at a position in the liquid flow path with a filter disposed inside the filter chamber, and a portion of the filter chamber which opposes the filter being made of an elastic member;

a pressing unit that presses the elastic member toward the filter; and a suction unit that suctions the liquid in the liquid flow path from the nozzle openings, wherein the direction of which the liquid flows out from the filter chamber is along the direction of which the pressing unit presses the elastic member, wherein the portion of the filter chamber which opposes the filter protrudes in a direction opposite to the filter, in the state of which the pressing unit does not contact the portion.

2. The liquid ejection apparatus according to claim 1 wherein the filter chamber is formed in a dome shape that protrudes in a direction opposite to the filter.

3. The liquid ejection apparatus according to claim 2 wherein the liquid ejecting head is movable in a main scan direction and a plurality of filter chambers are positioned side by side in a direction perpendicular to the main scan direction.

4. The liquid ejection apparatus according to claim 1 wherein a wall made of the elastic member that forms the filter chamber has a peripheral area that is inclined in a direction away from the filter and a center area that is formed to protrude toward the filter.

5. The liquid ejection apparatus according to claim 4 wherein the liquid ejecting head is movable in a main scan direction and a plurality of filter chambers are positioned side by side in a direction perpendicular to the main scan direction.

6. The liquid ejection apparatus according to claim 1 wherein the liquid ejecting head is movable in a main scan direction and a plurality of filter chambers are positioned side by side in a direction perpendicular to the main scan direction.

* * * * *